US010767446B2

(12) United States Patent
Shimmoto et al.

(10) Patent No.: US 10,767,446 B2
(45) Date of Patent: Sep. 8, 2020

(54) FLOAT VALVE SUB

(71) Applicants: JAPAN AGENCY FOR MARINE-EARTH SCIENCE AND TECHNOLOGY, Yokosuka-shi, Kanagawa (JP); NLC CO., LTD., Tokyo (JP)

(72) Inventors: Yuichi Shimmoto, Yokosuka (JP); Eigou Miyazaki, Yokosuka (JP); Keita Akiyama, Yokosuka (JP); Masaki Kawahara, Hitachi Ohmiya (JP); Tomoaki Suzuki, Hitachi Ohmiya (JP)

(73) Assignees: JAPAN AGENCY FOR MARINE-EARTH SCIENCE AND TECHNOLOGY, Yokosuka-shi (JP); NLC CO., LTD., Tokyo (JP)

( * ) Notice: Subject to any disclaimer, the term of this patent is extended or adjusted under 35 U.S.C. 154(b) by 259 days.

(21) Appl. No.: 15/746,221

(22) PCT Filed: Jul. 21, 2016

(86) PCT No.: PCT/JP2016/071390
§ 371 (c)(1),
(2) Date: Jan. 19, 2018

(87) PCT Pub. No.: WO2017/014263
PCT Pub. Date: Jan. 26, 2017

(65) Prior Publication Data

US 2018/0209245 A1 Jul. 26, 2018

(30) Foreign Application Priority Data

Jul. 21, 2015 (JP) ..... 2015-144300

(51) Int. Cl.
*E21B 34/10* (2006.01)
*E21B 34/12* (2006.01)
(Continued)

(52) U.S. Cl.
CPC ..... *E21B 34/10* (2013.01); *E21B 34/12* (2013.01); *E21B 25/02* (2013.01); *E21B 25/14* (2013.01); *E21B 2034/005* (2013.01)

(58) Field of Classification Search
CPC .... E21B 34/10; E21B 2034/005; E21B 25/00; E21B 25/14
See application file for complete search history.

(56) References Cited

U.S. PATENT DOCUMENTS 2,162,578 A 6/1939 Hacker
3,058,534 A 10/1962 Keithahn
(Continued)

FOREIGN PATENT DOCUMENTS

GB 892950 A 4/1962
WO 2014042541 A1 3/2014

OTHER PUBLICATIONS

International Preliminary Report on Patentability (with translation of the Written Opinion) dated Feb. 1, 2018, issued by the International Bureau in corresponding PCT Application No. PCT/JP2016/071390.

(Continued)

*Primary Examiner* — Tara E Schimpf
(74) *Attorney, Agent, or Firm* — Sughrue Mion, PLLC

(57) ABSTRACT

A concave section such as an extension section, a cutting section, and a notch section is provided to receive a lid of a float valve in an inside of outer tube assembly of a drill string. Thus, when the float valve is provided for the drill string, it is made possible to collect a core with a larger diameter by a thinner drill string, by expanding the inner diameter of the drill string.

4 Claims, 17 Drawing Sheets

(51) Int. Cl.

| | |
|---|---|
| *E21B 25/14* | (2006.01) |
| *E21B 34/00* | (2006.01) |
| *E21B 25/02* | (2006.01) |

(56) References Cited

U.S. PATENT DOCUMENTS

| | | | | |
|---|---|---|---|---|
| 3,066,693 | A | 12/1962 | Taylor, Jr. | |
| 3,318,387 | A | 5/1967 | Jones | |
| 3,446,237 | A | 5/1969 | Haley | |
| 4,457,376 | A | 7/1984 | Carmody et al. | |
| 4,691,775 | A * | 9/1987 | Lustig | E21B 34/063 166/317 |
| 6,152,232 | A | 11/2000 | Webb et al. | |
| 10,151,173 | B2 | 12/2018 | Horwell | |
| 2012/0205116 | A1 | 8/2012 | Macrae et al. | |
| 2015/0240596 | A1 | 8/2015 | Horwell | |

OTHER PUBLICATIONS

Communication dated Feb. 22, 2019, from European Patent Office in counterpart application No. 16827823.2.
International Search Report of PCT/JP2016/071390 dated Aug. 23, 2016.

* cited by examiner

FLOAT VALVE SUB

CROSS REFERENCE TO RELATED APPLICATIONS

This application is a National Stage of International Application No. PCT/JP2016/071390 filed Jul. 21, 2016, claiming priority based on Japanese Patent Application No. 2015-144300 filed Jul. 21, 2015, the contents of all of which are incorporated herein by reference in their entirety.

TECHNICAL FIELD

The present invention relates to a float valve sub used for a drill string, and especially to a float valve sub in which a float valve assembly is detachably attached to the inside of bottomhole assembly.

BACKGROUND ART

The technique is known that collects a sample core of stratum. For example, in the technique, a drill bit is provided onto the circumference at the end of a cylindrical structure which is called a drill string. The drill string is rotated to invade the inside of stratum. After that, the drill string is extracted from the stratum, and a stratum sample of a column-like shape is collected from the inside of drill string. It becomes possible to know the physical characteristics such as the structure and space percentage of the stratum in detail by analyzing the stratum sample collected in this way. For example, this technique is expected to contribute to the oil and gas layer evaluation and the research of earthquake.

When the stratum is drilled with the drill string, there is a possibility that the phenomenon called kick or blowout occurs by stratum fluid flowing into a well. For example, when there are liquid layers such as an underground water vein and an oil and gas layer in a region where the tip of the drill string has reached, a possibility could be considered in which the stratum fluid flows backward from the drill bit depending on pore pressure in the stratum, passes through the inside of drill string, and blows out onto a ship or to the ground, so as to make the continuation of drilling difficult. When such kick and blowout seem to occur, it is desirable to take a well control measure in which a blowout preventing device is provided inside the drill string previously to prevent the kick and the blowout appropriately.

In relation to the above, inventions of a flapper-type float valve are disclosed in Patent Literature 1 and Patent Literature 2. In these inventions, a float valve using a flapper-type lid is provided inside the drill string in any case.

CITATION LIST

Patent Literature

[Patent Literature 1] U.S. Pat. No. 2,162,578
[Patent Literature 2] U.S. Pat. No. 3,066,693

SUMMARY OF THE INVENTION

From the viewpoint of drilling work, it is desirable that the outer diameter of the drill string should be smaller. On the other hand, from the viewpoint of stratum analysis, it is desirable the inner diameter of the drill string should be larger to collect a stratum sample with a larger diameter. However, in the flapper-type float valve in the prior art, the flapper-type lid is provided inside the drill string so that a ratio of the minimum inner diameter of the float valve to the maximum outer diameter of a part of the drill string where the float valve is installed decreases significantly. This problem becomes more conspicuous in the drill string of a 2-layer structure to be mentioned later. Other subject matters and new features will become clear from the description of this Specification and the attached drawings.

According to one embodiment, a float valve sub 2 includes: an outer barrel assembly and a float valve assembly. Here, the float valve assembly is arranged detachably in the inside of outer barrel assembly. The float valve assembly includes: a first end section, a second end section, a float valve middle section, and a lid section. Here, each of the first end section and the second end section has a cylindrical shape. The float valve middle section is arranged between the first end section and the second end section. The lid section is attached to the first end section, and moves turnably between a first position and a second position. Here, the lid section closes a passage of the first end section in the first position and opens a float valve first opening section as the passage of the first end section in the second position. The float valve middle section has a side opening through which a part of the lid section is possible to pass. The outer barrel assembly includes: a first section, a second section, and an outer barrel middle section.

Here, the first section has an inner circumference surface complementary to an outer circumference surface of the first end section to receive the first end section. The second section has an inner circumference surface complementary to an outer circumference surface of the second end section to receive the second end section. The outer barrel middle section is arranged between the first section and the second section. The outer barrel middle section has a concave section possible to receive the lid section in the second position. A minimum inner diameter of the first section is larger than that of the second section, and an inner diameter of the concave section is larger than the minimum inner diameter of the first section.

According to the one embodiment, when the flapper-type float valve is installed in the drill string, the ratio of the minimum inner diameter of the float valve to the maximum outside diameter of the part of the drill string where the float valve is installed can be improved.

DESCRIPTION OF THE EMBODIMENTS

Embodiments of a float valve sub will be described below with reference to the attached drawings.

Figure 1:
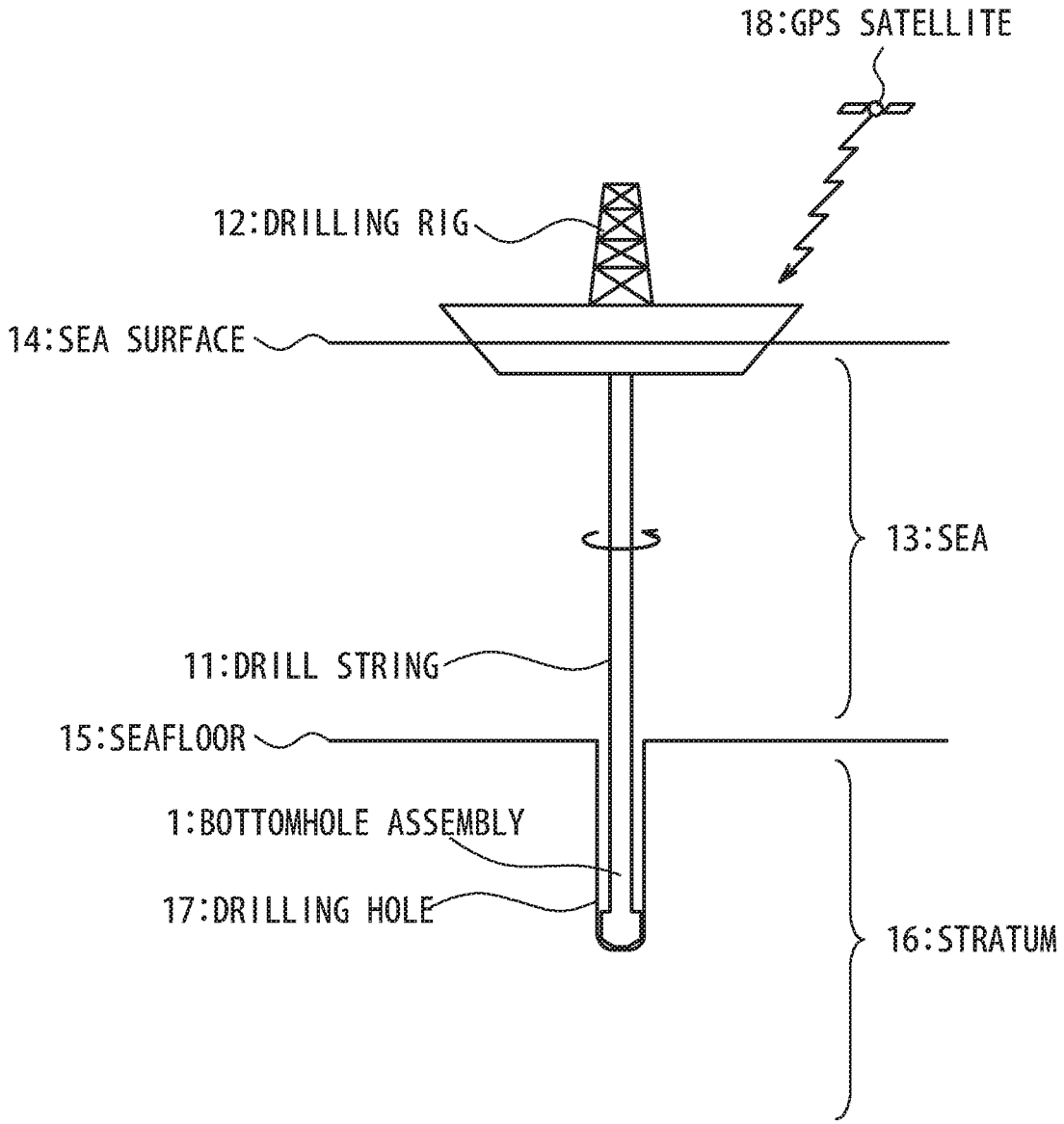
FIG. 1 is a diagram showing a configuration example of a coring system (a kind of bottomhole assembly) which drills the seafloor.

A coring technique to collect a sample from the strata of seafloor will be described as an example. FIG. 1 is a diagram showing a configuration example of a coring system which drills the seafloor. Here, the coring system is a kind of bottomhole assembly 1. In an example shown in FIG. 1, first, a drilling rig 12 is prepared on the sea surface 14 straightly above the seafloor 15 to be drilled. It is desirable that the drilling rig 12 continues to keep the position the drilling rig 12 straightly above a drilling position by using GPS (global positioning system) satellite 18 and so on. The drilling rig 12 is used to repeat a process of elongating a drill string 11 and listing down the elongated drill string 11 into the sea 13. When a tip of the drill string 11 (to be referred to as a drilling hole 17) reaches the stratum 16 of seafloor 15, the drilling rig 12 controls the drill string 11 to collect a stratum sample core from the stratum 16 of seafloor 15.

However, there is a case where the distance from the sea surface 14 to the seafloor 15 is thousands of meters. In such a case, if the whole of drill string 11 is lifted up and down every time one core is collected, the work efficiency is very low. Therefore, a technique is known in which the cores are continuously recovered in the drilling rig 12 by use of an inner barrel section inserted inside an outer barrel section of the drill string 11 without lifting up the drill string 11 after the drilling by use of the drill string 11 is once started. As one of such techniques, a wire line recovery system is known.

Note that the coring system shown in FIG. 1 is usable in the stratum drilling on a land in addition to the seafloor drilling.

Figure 2A:
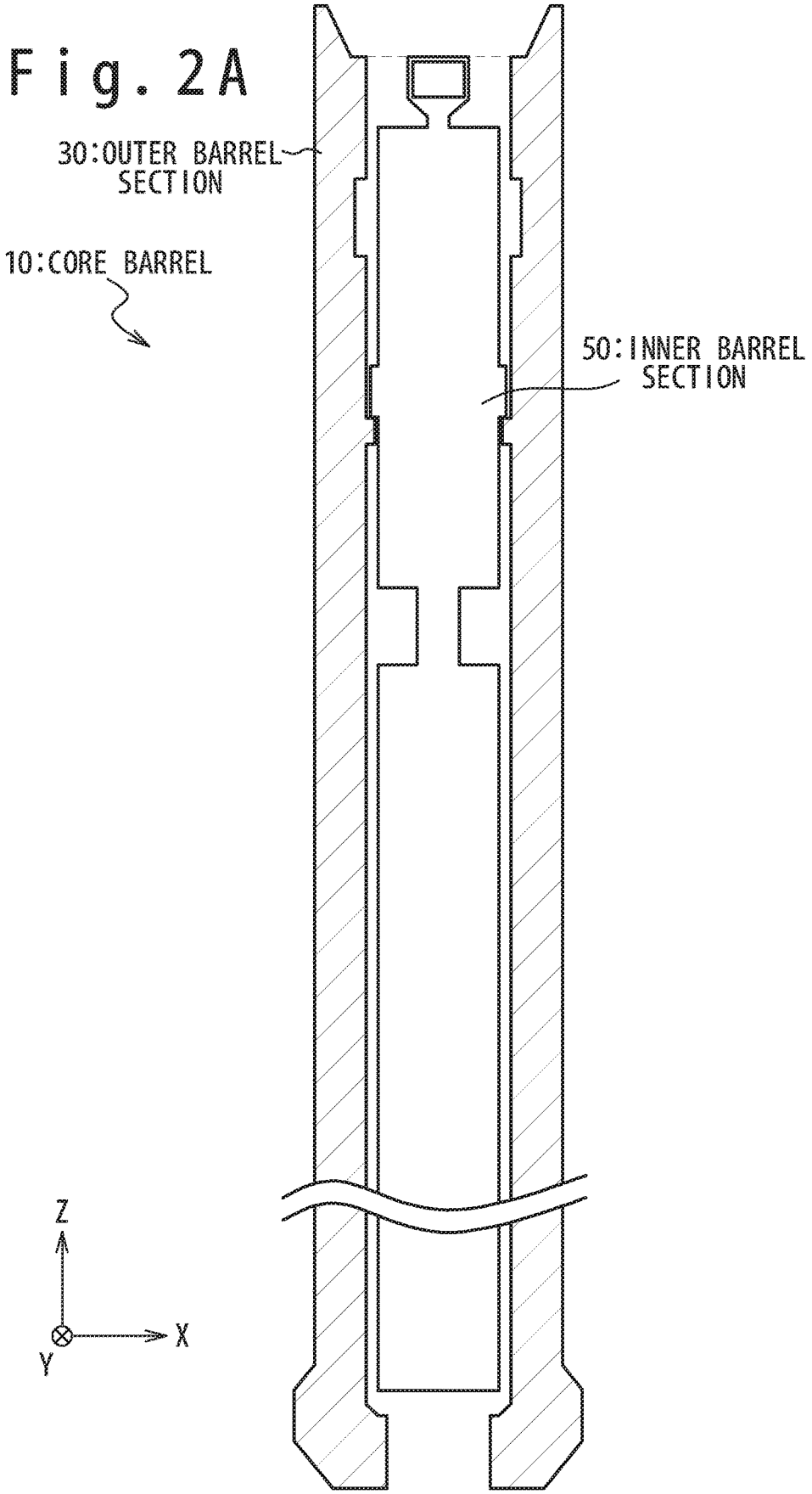
FIG. 2A is a partial sectional view showing a configuration example of a core barrel provided for a distal end of the drill string used in a wire line recovery system.

FIG. 2A is a sectional view showing a configuration example of a core barrel 10 which is provided in a distal end of the drill string 11 used in the wire line recovery system. The core barrel 10 shown in FIG. 2A has a 2-layer structure, and an outer barrel section 30 is provided outside and an inner barrel section 50 is provided inside. The outer barrel section 30 has a cylindrical shape, and the inner barrel section 50 is movable inside the outer barrel section 30 in a longitudinal direction of the core barrel 10 (the direction of ±Z in the coordinates shown in FIG. 2A) in the inside of outer barrel section.

Note that in FIG. 2A, a sectional view of the outer barrel section 30 is shown and a side view of the inner barrel section 50 is shown. The outer barrel section 30 is provided in the distal end of the drill string 11.

Figure 2B:
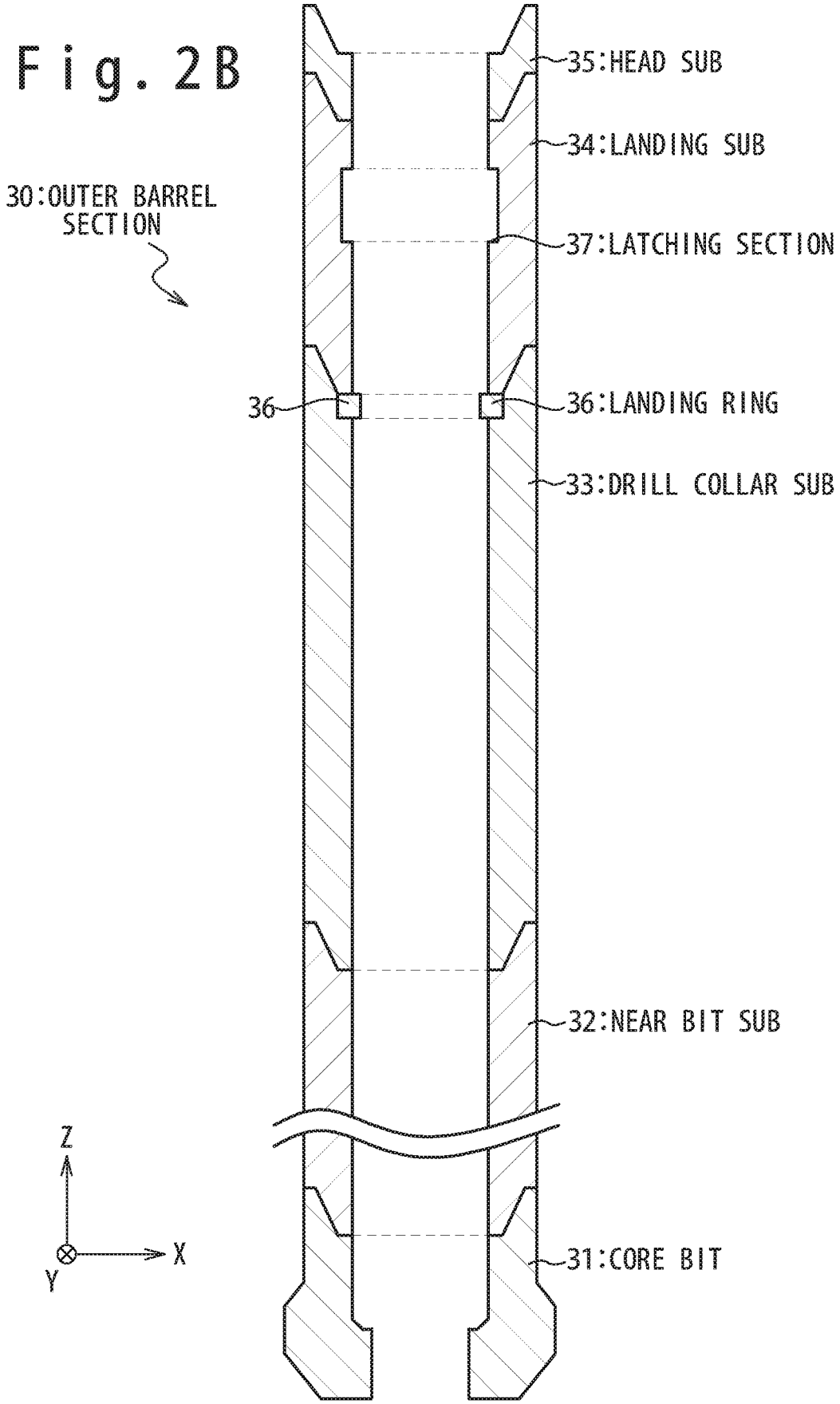
FIG. 2B is a sectional view showing a configuration example of an outer barrel section of the core barrel shown in FIG. 2A.

FIG. 2B is a sectional view showing a configuration example of the outer barrel section 30 of the core barrel 10 shown in FIG. 2A. The outer barrel section 30 shown in FIG. 2B has a core bit 31, a near bit sub 32, a drill collar sub 33, a landing sub 34, a head sub 35, a landing ring 36 and a latching section 37.

The core bit 31 is provided in the distal end of the outer barrel section 30. The near bit sub 32 is connected with an upper end section of the core bit 31. The drill collar sub 33 is connected with an upper end section of the near bit sub 32. The landing sub 34 is connected with an upper end section of the drill collar sub 33. The head sub 35 is connected with an upper end section of the landing sub 34. The landing ring 36 is provided near an upper end opening section on an inner wall of the drill collar sub 33. The latching section 37 contains a space formed by boring an inner wall of the landing sub 34.

Figure 2C:
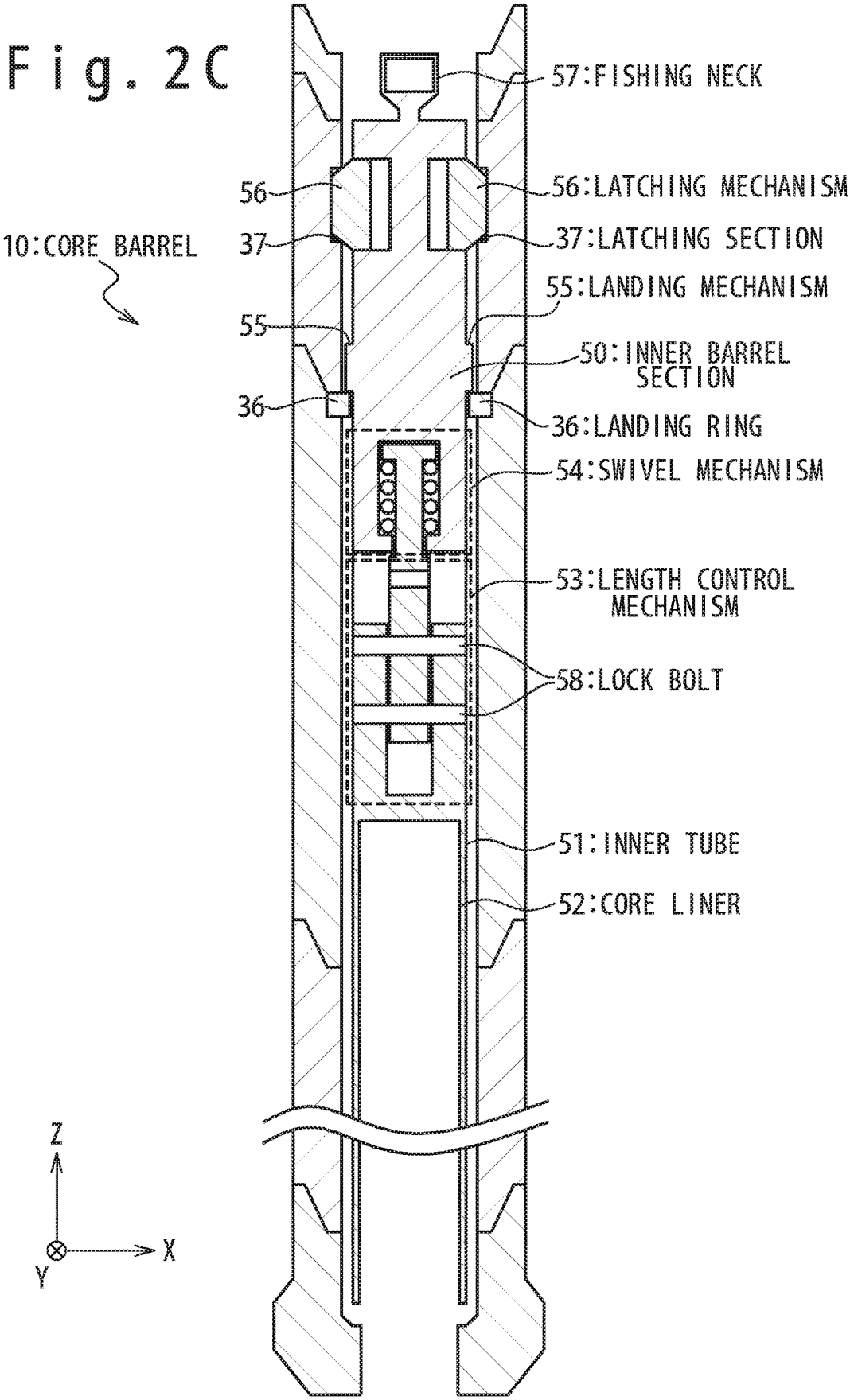
FIG. 2C is a sectional view showing a configuration example of an inner barrel section of the core barrel shown in FIG. 2A in detail.

FIG. 2C is a diagram showing a configuration example of the inner barrel section 50 of the core barrel 10 shown in FIG. 2A in detail. The inner barrel section 50 shown in FIG. 2C has an inner tube 51, a core liner 52, a length control mechanism 53, a swivel mechanism 54, a landing mechanism 55, a latching mechanism 56 and a fishing neck 57. Here, the length control mechanism 53 has lock bolts 58.

The inner tube 51 is provided in the distal end of the inner barrel section 50. The core liner 52 is provided inside the inner tube 51. The length control mechanism 53 is provided on an upper-end side from the inner tube 51. The swivel mechanism 54 is provided on an upper-end side from the length control mechanism 53. The landing mechanism 55 is provided on an upper-end side of the swivel mechanism 54. The latching mechanism 56 is provided on an upper-end side from the landing mechanism 55. The fishing neck 57 is provided on an upper-end side from the latching mechanism 56.

The fishing neck 57 is used to detachably connect the inner barrel section 50 with a wire line extending from the drilling rig 12. The drilling rig 12 controls the wire line to be attached to or detached from the fishing neck 57.

The latching mechanism 56 is engaged with the latching section 37 to fix the inner barrel section 50 to the outer barrel section 30. When the latching mechanism 56 is fixed to the outer barrel section 30, the rotation of the outer barrel section 30 is transferred to the inner barrel section 50. Also, the engagement of the latching mechanism 56 with the latching section 37 is canceled when the inner barrel section 50 is to be recovered to the drilling rig 12 through the wire line.

The landing mechanism 55 controls a position relation in the longitudinal direction of the drill string 11 between the inner barrel section 50 and the outer barrel section 30. In an example shown in FIG. 2C, the outer diameter of the landing mechanism 55 is larger than the inner diameter of the landing ring 36. The position relation between the inner barrel section 50 and the outer barrel section 30 may be determined by putting a lower surface of the landing mechanism 55 on the upper surface of the landing ring 36, when the inner barrel section 50 is lifted down from the drilling rig 12 to the end section of the outer barrel section 30.

The swivel mechanism 54 is provided to prevent the core liner 52 arranged in a distal end of the swivel mechanism from being rotated following the rotation of the outer barrel section 30 so that the core on the way of collection is not twisted to the drilled stratum. In an example shown in FIG. 2C, the swivel mechanism 54 has an outer section connected to an upper end side of the inner barrel section 50, an inner section connected to a lower end side thereof and a bearing provided between the outer section and the inner section. The rotation of the outer barrel section 30 is not transferred to the components of the inner barrel section 50 which are arranged on the lower side from the swivel mechanism 54.

The length control mechanism 53 is provided to control the full length of the inner barrel section 50. The length control mechanism 53 has an inner section connected with an upper-end side of the inner barrel section 50, an outer section connected with a lower-end side thereof and lock bolts 58 connecting the inner section and the outer section. Each of the inner section and the outer section has a plurality of holes through which the lock bolts 58 pass. The length of inner barrel section 50 can be controlled by selecting the holes through which the lock bolts 58 pass suitably, in each of the inner section and the outer section of the length control mechanism 53.

The inner tube 51 supports the core liner 52 in its inside. The core liner 52 stores the collected core. It is desirable that the inner tube 51 has a core catcher and a core lifter which are not illustrated. Here, the core catcher and the core lifter separate the core to be collected from the stratum. Also, they support the core detached from the stratum 16 to prevent the core from falling down. Note that any one of the core catcher and the core lifter may be used.

Note that the outer barrel section 30 and the inner barrel section 50 shown in FIG. 2A to FIG. 2C are called a rotary core barrel, and is used when the stratum 16 to be collected is comparatively hard. When the stratum 16 to be collected is comparatively soft, the inner barrel section 50 having another configuration may be used.

Figure 3A:
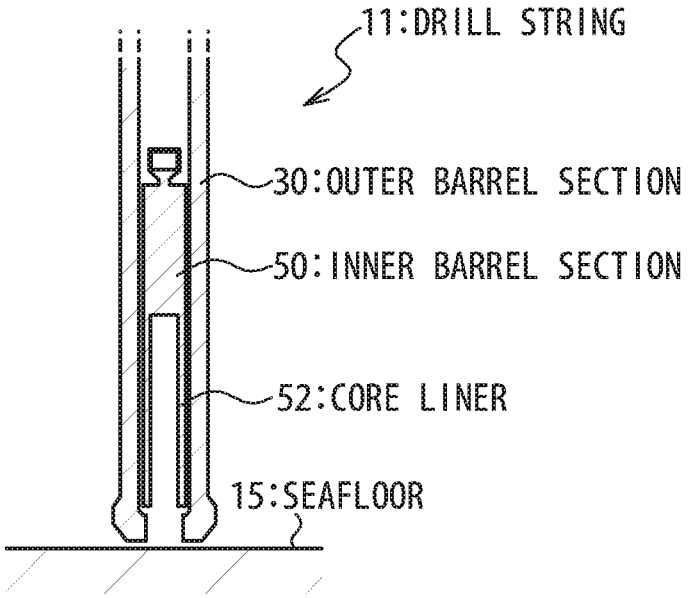
FIG. 3A is a diagram showing a first step of an example of core collecting technique using the core barrel shown in FIG. 2A to FIG. 2C.
Figure 3B:
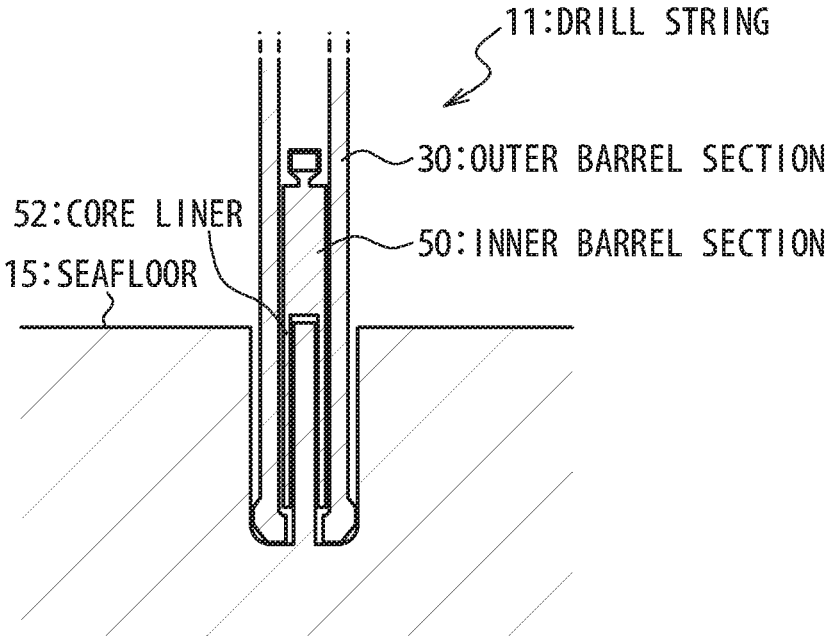
FIG. 3B is a diagram showing a second step of the example of core collecting technique.
Figure 3C:
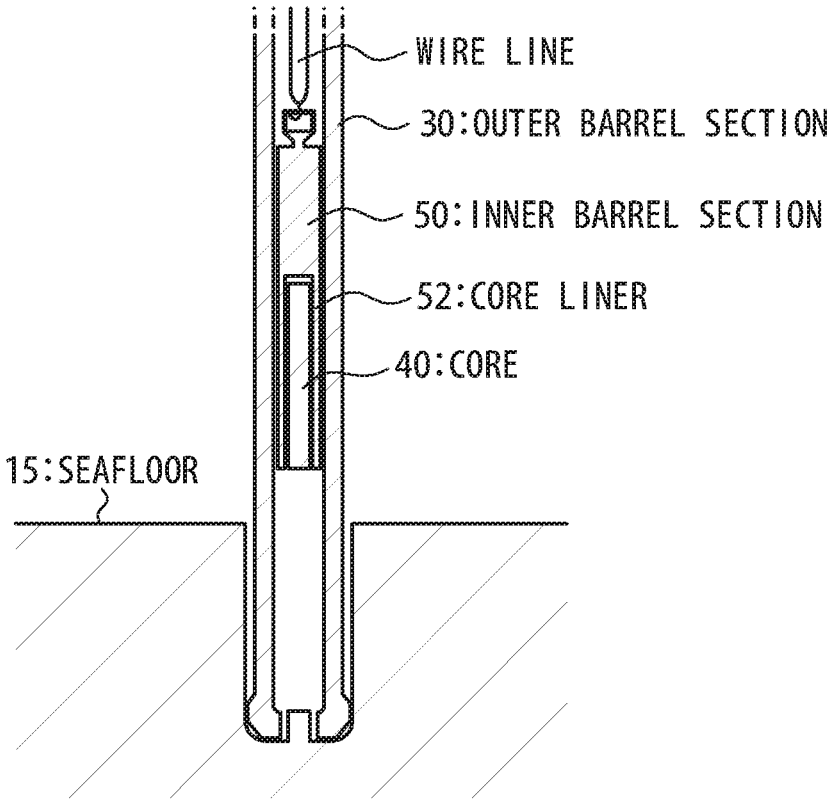
FIG. 3C is a diagram showing a third step of the example of core collecting technique.

FIG. 3A to FIG. 3C are diagrams showing steps of an example of collecting the core by using the drill string 11 shown in FIG. 2A to FIG. 2C.

At a first step shown in FIG. 3A, the drill string 11 is extended toward the stratum 16 for a sample to be collected, and the inner barrel section 50 is lifted down toward the outer barrel section 30 through the inside of drill string 11. At this time, it is desirable that an opening of core bit 31 provided in a tip of outer barrel section 30 and an opening of core liner 52 provided in a tip of inner barrel section 50 overlap in the drilling proceeding direction of the drill string 11. Note that the drilling proceeding direction of the drill string 11 coincides with the longitudinal direction of the drill string 11, and also coincides with the direction of rotation axis of the drill string 11.

At a second step shown in FIG. 3B, the drill string 11 is rotated around the rotation axis and drills the stratum 16. At this time, a part of the stratum 16 is supplied to the inside of core liner 52 through the opening of core bit 31.

At a third step shown in FIG. 3C, the drilling rig 12 extends the wire line into the inside of outer barrel section 30 so as to be connected with the fishing neck 57 of the inner barrel section 50, and to lift up the inner barrel section 50 together with the wire line. At this time, the part of stratum 16 stored in the core liner 52 is separated from the stratum 16 and supported by the core catcher and the core lifter and then is collected as a core 40 of a stratum sample.

After that, after the core 40 is taken out from the inner barrel section 50 which has been lifted up to the drilling rig 12, the steps from the first step to the third step are repeated. In this way, the cores 40 can be continuously recovered without lifting up the drill string 11 which contains the outer barrel section 30.

A technique using a casing pipe is known to carry out the drilling more deeply. When the stratum 16 is drilled by use of the drill string 11, there is a possibility that the stratum surrounding the drilling hole 17 collapses so that the rotation of the drill string 11 and the drilling are hindered and the continuation of the drilling becomes difficult. To prevent these situations, it could be considered that the inner wall of the drilling hole 17 is reinforced with the casing pipe protecting the drill string 11, after the drilling to a depth of some degree is carried out.

Because the outer diameter of the casing pipe allowing insertion into the drilling hole 17 is equal to the outer diameter of the core bit 31 having drilled this drilling hole 17, another core bit 31 with the smaller outer diameter becomes necessary to further drill the drilling hole 17 reinforced with the casing pipe. Also, the drilling hole 17 which has been drilled with the core bit 31 with the smaller outer diameter is reinforced with another thinner casing pipe. The deeper drilling becomes possible by repeating such steps.

Figure 4:
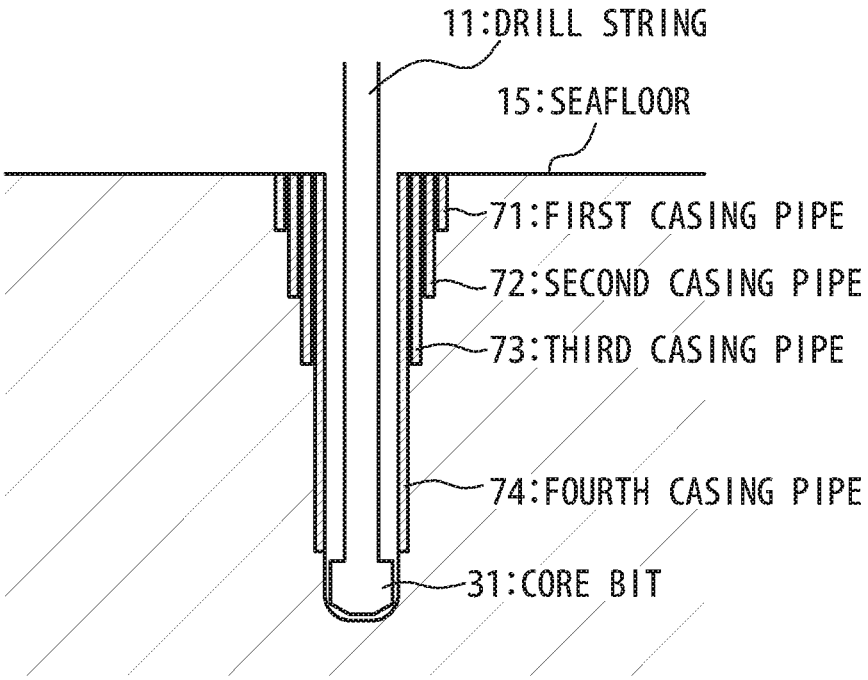
FIG. 4 is a diagram showing an example of core collecting technique in which a casing pipe is combined with the drill string shown in FIG. 2A to FIG. 2C.

FIG. 4 is a partial sectional view showing an example of the coring technique in which the casing pipe and the drill string 11 shown in FIG. 2A to FIG. 2C are combined.

The sectional view shown in FIG. 4 contains the stratum 16, the drill string 11, a first casing pipe 71, a second casing pipe 72, a third casing pipe 73 and a fourth casing pipe 74.

The first casing pipe 71 to the fourth casing pipe 74 are structures having a circular cylinder shape different from each other in thickness and length. The outer diameter of the first casing pipe 71 is the thickest, the outer diameter of the second casing pipe 72 is next thicker, the outer diameter of the third casing pipe 73 is next thicker, and the outer diameter of the fourth casing pipe 74 is the thinnest. Also, the first casing pipe 71 is the shortest, the second casing pipe 72 is next shorter, the third casing pipe 73 is next shorter, and the fourth casing pipe 74 is the longest.

The first casing pipe 71 to the fourth casing pipe 74 are arranged concentrically when seeing from a directly upper position of the drilling hole 17, and are buried in the stratum 16. The upper end of each of the first casing pipe 71 to the fourth casing pipe 74 may be situated on the surface of the stratum 16.

The drilling depth possible to drill is improved by using a plurality of casing pipes although the thickness (the outer diameter) of usable core bit 31 become thinner in a step-by-step manner. Therefore, the outer diameter and inner diameter of usable drill string 11 become smaller in the step-by-step manner.

Moreover, when a float valve is provided inside the drill string 11 to prevent a blowout, a partial inner diameter of the drill string 11 is decreased more. Therefore, a ratio of the inner diameter to the outer diameter in the drill string 11 is decreased more.

First Embodiment

In a first embodiment, a structure is proposed in which the decrease of the ratio of the inner diameter to the outer diameter can be restrained even if the float valve is provided inside the drill string.

Figure 5A:
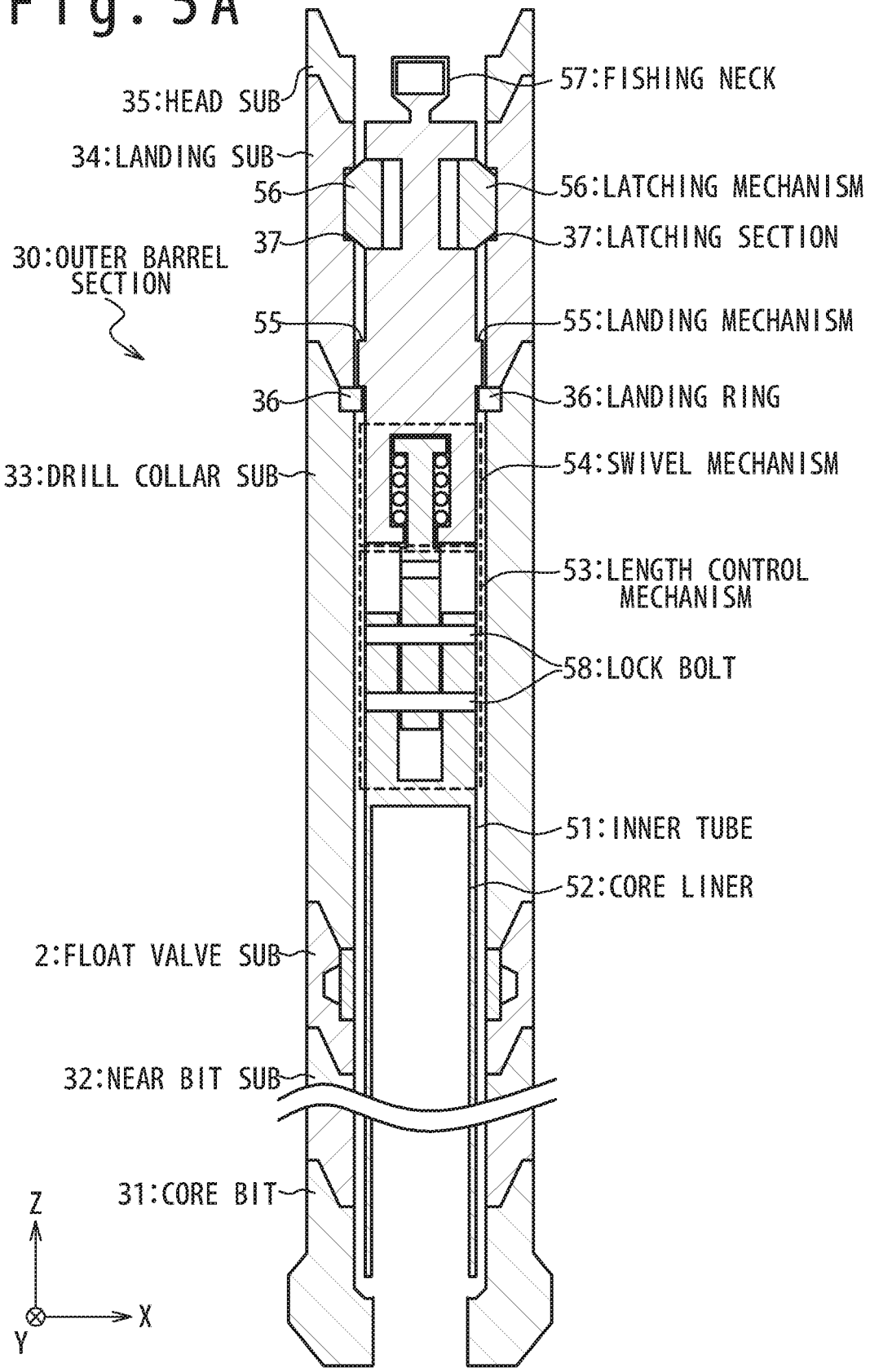
FIG. 5A is a sectional view showing a configuration example of the core barrel using a float valve sub according to one embodiment.

FIG. 5A is a sectional view showing a configuration example of the outer barrel section 30 which uses the float valve sub according to this embodiment. The structure of the outer barrel section 30 shown in FIG. 5A is the same as the structure in which the float valve sub 2 according to this embodiment is added to the outer barrel section 30 shown in FIG. 2A to FIG. 2C. The float valve sub 2 is arranged between the drill collar sub 33 and the near bit sub 32, and the inner tube 51 passes inside the float valve sub 2.

Note that the float valve sub 2 according to this embodiment may be arranged in another position of the outer barrel section 30. For example, the float valve sub 2 according to this embodiment may be arranged between the core bit 31 and the near bit sub 32. Or, the float valve sub 2 may be arranged between the landing sub 34 and the drill collar sub 33. As a further modification example, the float valve sub 2 according to this embodiment can be provided for a rotary core barrel of a so-called conventional type in which the inner tube 51 is not removed.

The other components contained in the outer barrel section 30 shown in FIG. 5A are same as those in case of FIG. 2A to FIG. 2C. Therefore, further detailed description is omitted.

Note that it is desirable that the shape of each of the subs including the float valve sub 2 has a rotation symmetry as high as possible with respect to the rotation axis of the drill string 11 in order for the drill string 11 to rotate stably. Also, it is desirable that each sub has a higher rotation symmetry, if possible, to realize the shaping and processing more preciously and more easily. For these reasons, the rotating bodies such as a circle, a disk, a column, and a circular cylinder appear in various portions of the following description. Here, these rotating bodies are not limited to the circle, the disk, the column, the circular cylinder and so on which are strictly geometrically defined. These rotating bodies may contain modifications in actual ranges of an extent not hinder the stable rotation of the drill string 1, and the assembling of subs and so on.

Figure 5B:
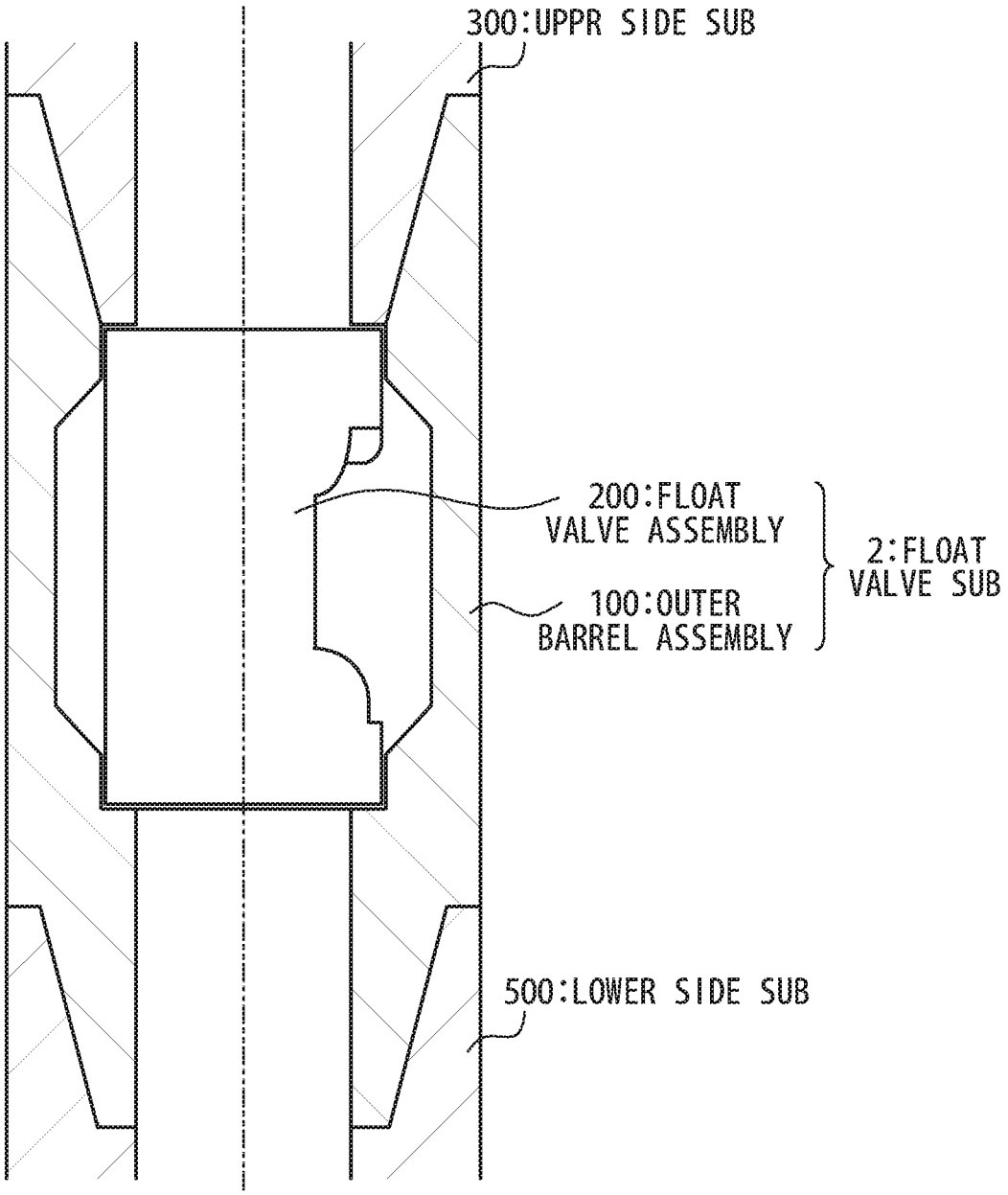
FIG. 5B is a partial sectional view showing a connection relation of the float valve sub according to the embodiment with another sub.

FIG. 5B is a partial sectional view showing connection relation of the float valve sub 2 according to the present invention to another sub.

The float valve sub 2 shown in FIG. 5B has an outer barrel assembly 100 as an outer cylinder assembly and a float valve assembly 200. The float valve assembly 200 is arranged inside the outer barrel assembly 100. FIG. 5B is a sectional view of the outer barrel assembly 100.

The float valve sub 2 shown in FIG. 5B is connected on its upper-end side with an upper side sub 300. Also, the float valve sub 2 shown in FIG. 5B is connected on its lower-end side with a lower side sub 500. It is desirable to use tapered screws which are excellent in water-tightness, for the connection of the upper side sub 300 and the float valve sub 2 and the connection of the float valve sub 2 and the lower side sub 500.

Figure 6:
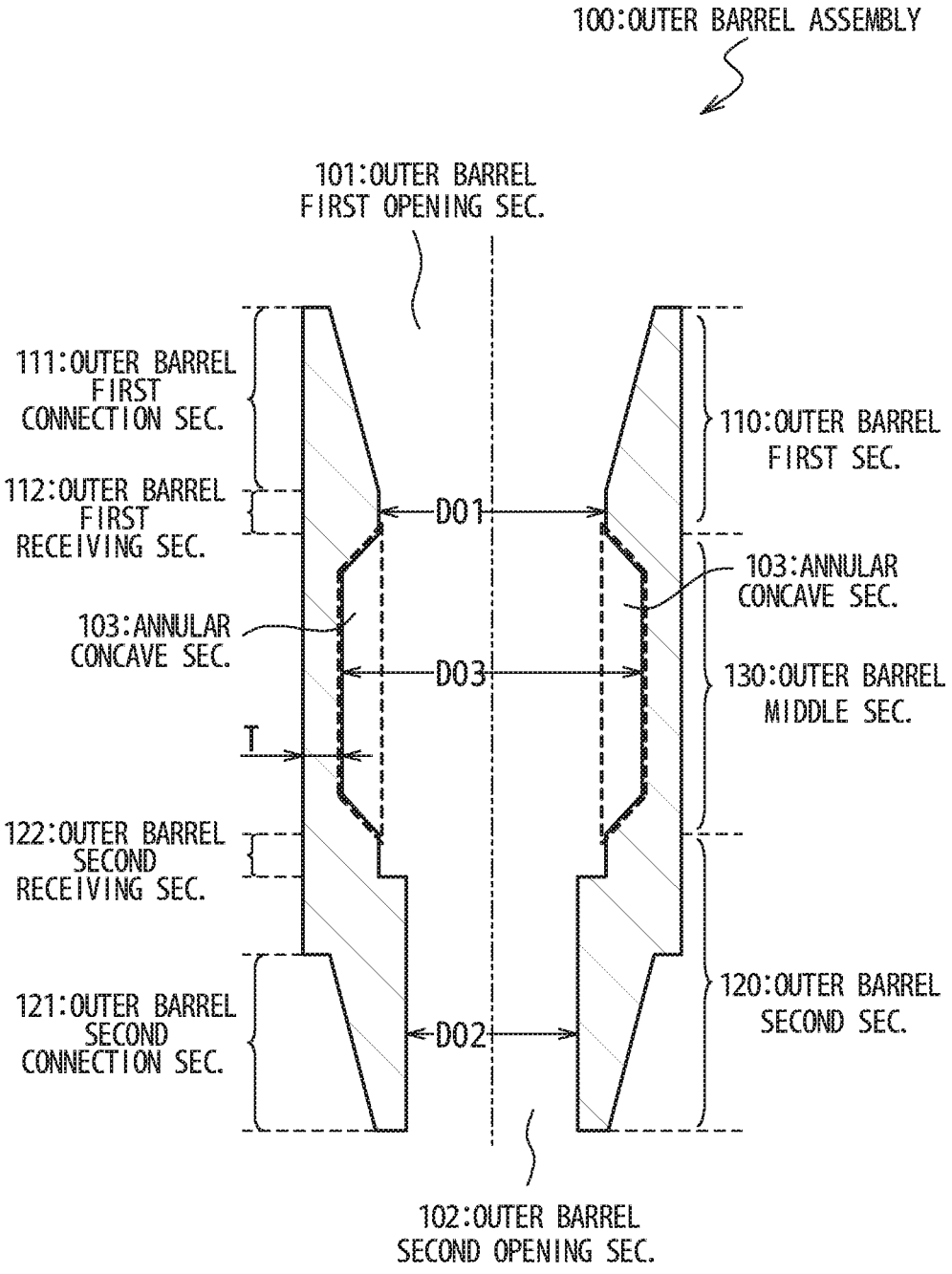
FIG. 6 is a sectional view showing a configuration example of an outer barrel assembly of the float valve sub according to the embodiment.

FIG. 6 is a sectional view showing a configuration example of the outer barrel assembly 100 of the float valve sub 2 according to this embodiment.

It is desirable that the outer barrel assembly 100 as an outer cylinder assembly is formed of a single member from the viewpoint of strength and water-tightness. The outer barrel assembly 100 has an outer barrel first section 110, an outer barrel second section 120 and an outer barrel middle section 130.

The outer barrel first section 110 is a proximal end of the outer barrel assembly 100. The outer barrel second section 120 is a distal end of the outer barrel assembly 100. The outer barrel middle section 130 is arranged between the outer barrel first section 110 and the outer barrel second section 120.

The outer barrel first section 110 has an outer barrel first connection section 111 and an outer barrel first receiving section 112. Also, a space inside the outer barrel first section 110 is called an outer barrel first opening section 101.

The outer barrel first connection section 111 is connected with a lower-end-side connection section of the upper side sub 300. In the configuration example shown in FIG. 5B and FIG. 6, a tapered female screw is formed inside the outer barrel first connection section 111, and is engaged with a tapered male screw formed outside the lower-end-side connection section of the upper side sub 300.

The inner circumference surface of the outer barrel first receiving section 112 has a complementary shape to the upper-side end section (an outer circumference surface of the upper-side end section) of the float valve assembly 200, and receives and supports the upper-side end section of the float valve assembly 200. Note that the outer barrel first receiving section 112 has a shape by which the whole float valve assembly 200 can pass to an outer barrel second receiving section 122 when the float valve assembly 200 is attached to the outer barrel assembly 100.

Similarly, the outer barrel second section 120 has an outer barrel second connection section 121 and an outer barrel second receiving section 122. Also, a space inside the outer barrel second section 120 is called an outer barrel second opening section 102.

The outer barrel second connection section 121 is connected with the upper-end-side connection section of the lower side sub 500. In the configuration example shown in FIG. 5B and FIG. 6, a tapered male screw is formed outside the outer barrel second connection section 121, and is engaged with a tapered female screw formed inside an upper-end-side connection section of the lower side sub 500.

The inner circumference surface of the outer barrel second receiving section 122 has a shape which is complementary to the lower-side end section of the float valve assembly 200 (the outer circumference surface of the lower-side end section), and receives and supports the lower-side end section of the float valve assembly 200. Note that the outer barrel second receiving section 122 has a shape by which the float valve assembly 200 does not fall on the side of the lower side sub of the outer barrel assembly 100. As an example of such a shape, in a configuration example shown in FIG. 6, a minimum inner diameter DO2 of the outer barrel second section 120 is smaller than the minimum inner diameter DO1 of the outer barrel first section 110. Note that this minimum inner diameter DO2 is smaller than the maximum outer diameter of the float valve assembly 200 although the inner tube 51 can pass through the inside of the outer barrel second section 120.

There is a space to receive the float valve assembly 200 inside the outer barrel middle section 130. The outer barrel first opening section 101 is connected with the upper-side of this space. The outer barrel second opening section 102 is connected with the lower-side of this space. There is an annular concave section 103 on the outer circumference surface of this space and on the inner circumference surface of the outer barrel middle section 130. The annular concave section 103 may be formed by boring the inner wall of the outer barrel assembly 100. The annular concave section 103 is provided to receive a flapper lid which protrudes out of a cylindrical shape section of the float valve assembly 200 as mentioned later. The inner diameter DO3 of the annular concave section 103 is larger than the minimum inner diameter DO1 of the outer barrel first section 110.

The inner diameter of the upper side of the outer barrel middle section 130 in the boundary with the outer barrel first section 110 is equal to the inner diameter D01 of the outer barrel first receiving section 112. The inner diameter DO3 of the annular concave section 103 of the outer barrel middle section 130 is larger than the inner diameter DO1 of the outer barrel first receiving section 112. Here, there may be a region where the inner diameter continuously changes from DO1 to DO3 in the upper-side inner circumference of the outer barrel middle section 130.

Similarly, the inner diameter of the lower-side from the outer barrel middle section 130 in a boundary with the outer barrel second section 120 is equal to the inner diameter D01 of the outer barrel second receiving section 122. The inner diameter DO3 of the annular concave section 103 of the outer barrel middle section 130 is larger than the inner diameter DO1 of the outer barrel second receiving section 122. Here, there may be a region where the inner diameter changes continuously from DO3 to DO1 in the lower-side inner circumference surface of the outer barrel middle section 130.

Note that in this embodiment, the inner diameter of the lower-side of the outer barrel middle section 130 in the boundary with the outer barrel second section 120 is equal to the inner diameter D01 of the outer barrel first receiving section 112. However, the former can be made smaller than latter.

It is assumed that the minimum thickness of the drill pipe of the drill string 11 is Tmin. Here, the drill pipe is an outer wall portion of the drill string 11 which is on the side of the drilling rig 12 from the rotary core barrel, and has a function of transferring a rotation motion to the rotary core barrel from the drilling rig 12 and so on. Because the outer diameter of the outer barrel assembly 100 is generally larger than the outer diameter of the drill pipe, the strength which is required to the outer barrel assembly 100 as a part of the structure configuring the drill string 11 is secured even in any portion of the outer barrel assembly 100 if the thickness is above the minimum thickness Tmin. Therefore, it is desirable that the thickness T is above the minimum thickness Tmin, assuming that the thickness of annular concave section 103 of the side wall of the outer barrel assembly 100 is T. Note that when a value above the minimum thickness Tmin cannot be secured as the thickness T, the material of the outer barrel assembly 100 may be changed to a stronger material.

Figure 7A:
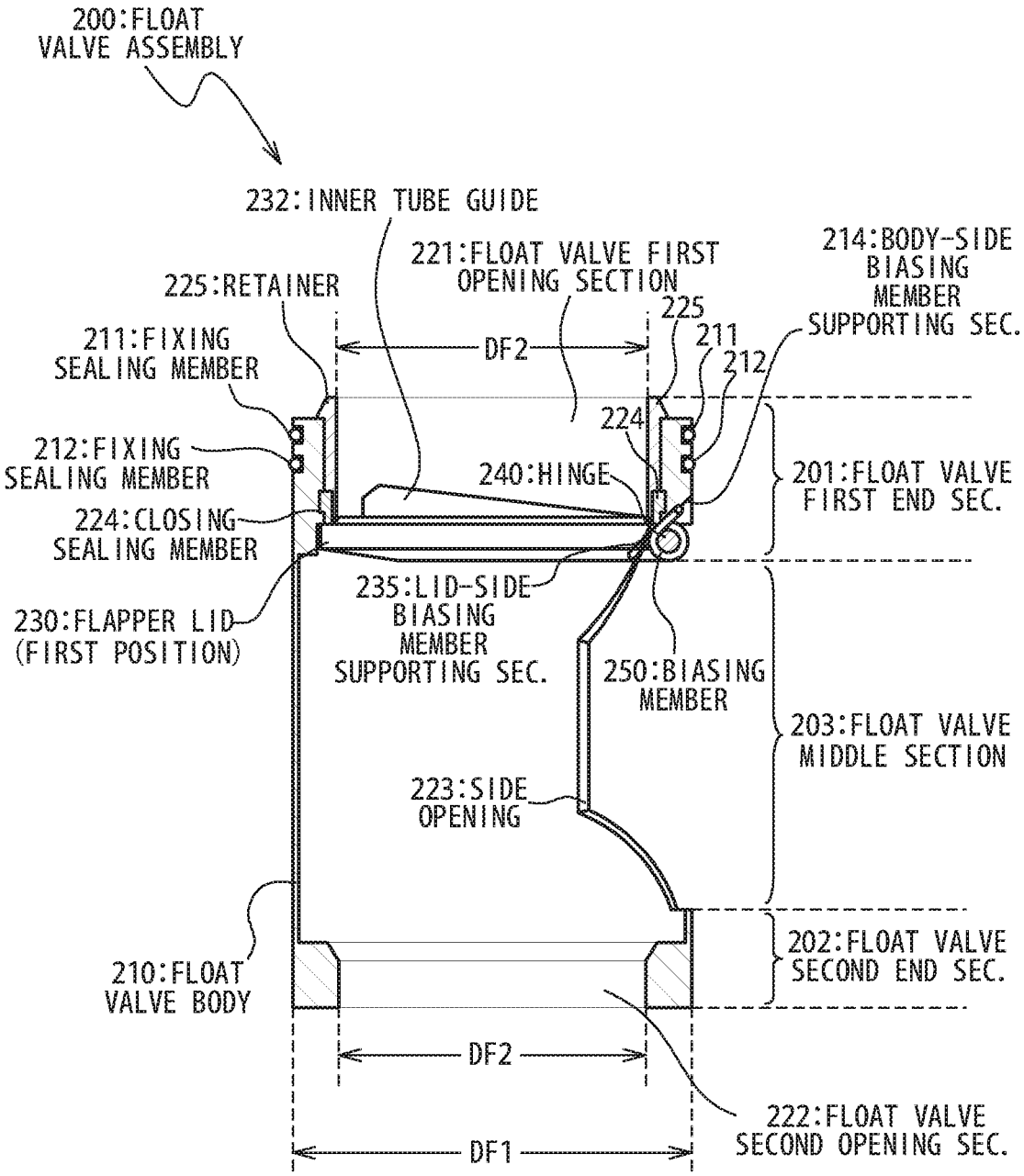
FIG. 7A is a diagram showing a state of a configuration example of a float valve assembly according to the embodiment when a flapper lid is in a first position.
Figure 7B:
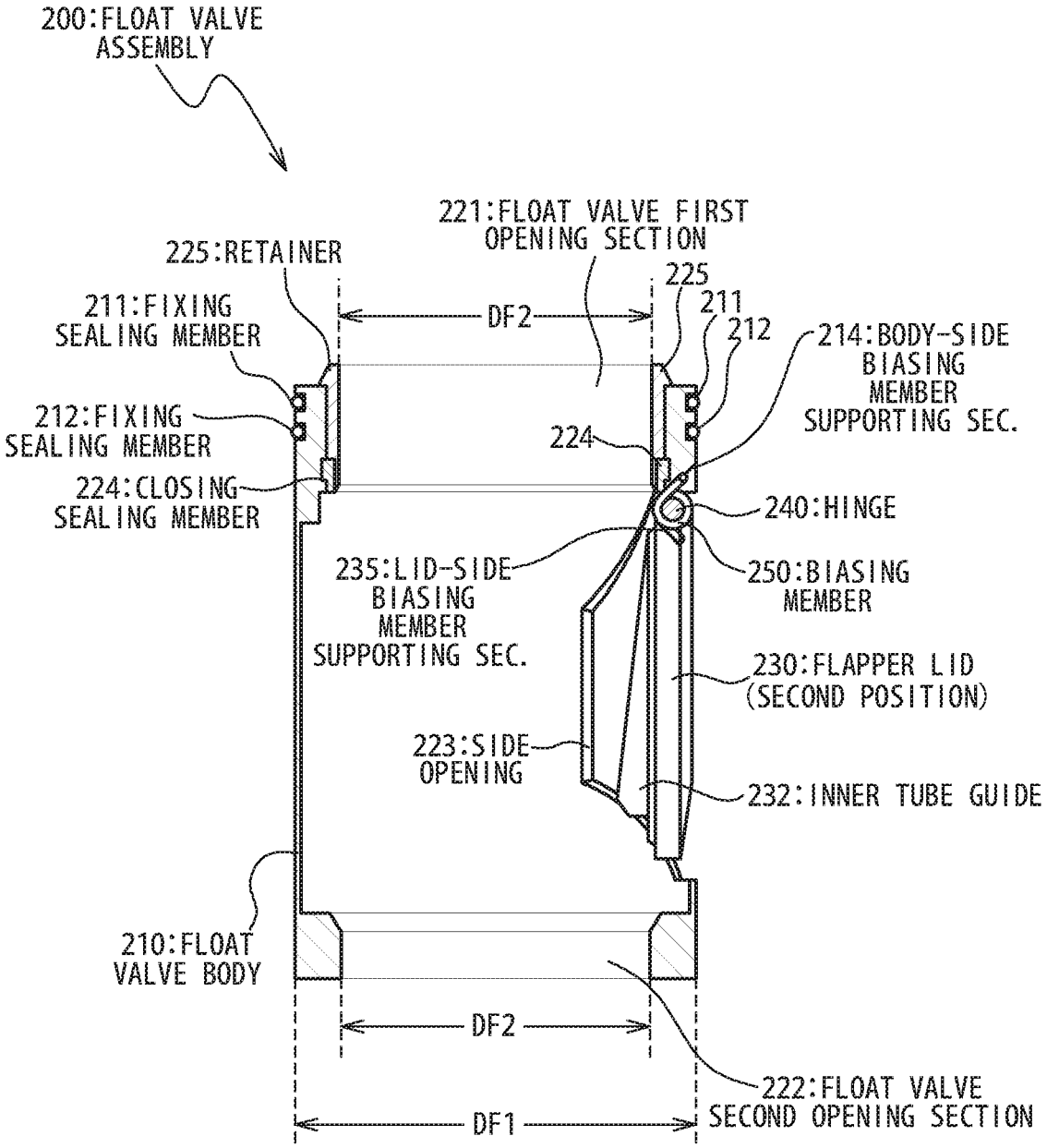
FIG. 7B is a diagram showing a state of the configuration example of the float valve assembly according to the embodiment when the flapper lid is in a second position.
Figure 7C:
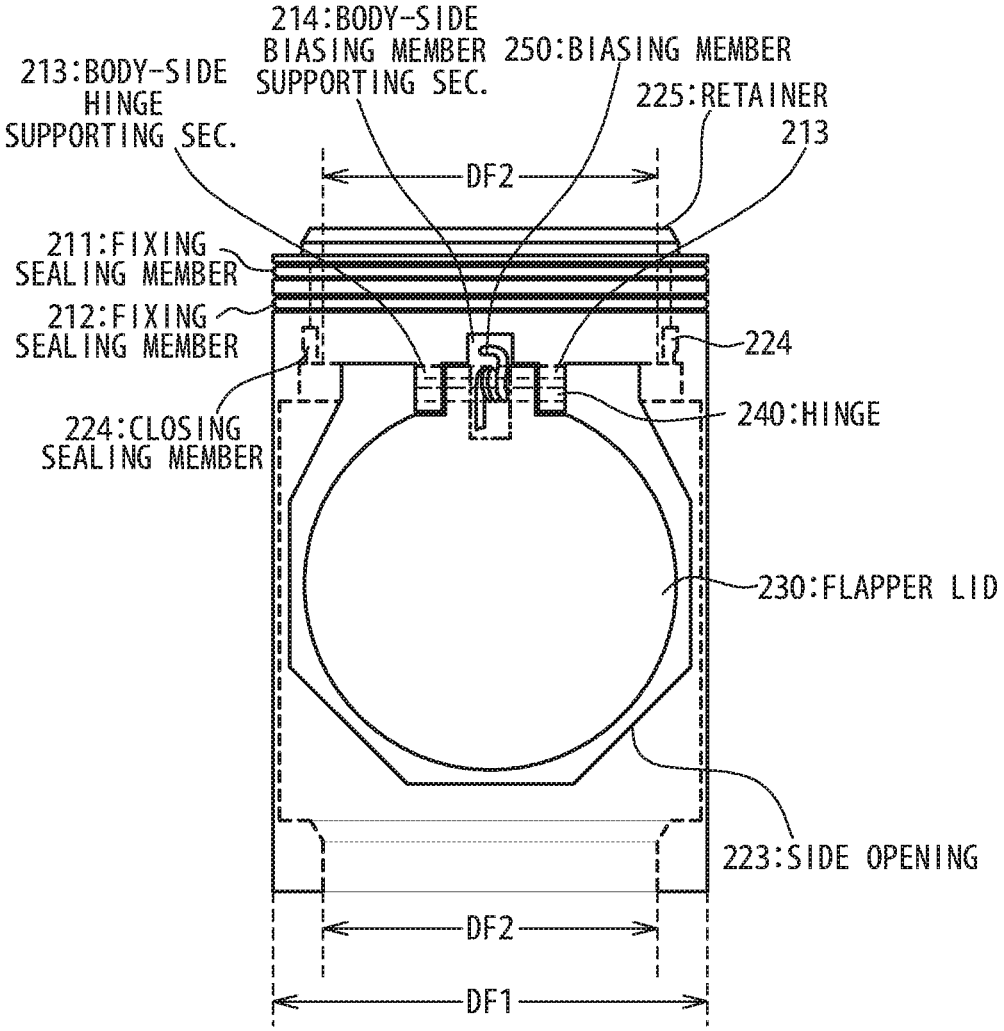
FIG. 7C is a side view of the float valve assembly in the state shown in FIG. 7B.

FIG. 7A is a diagram showing the state of a configuration example of the float valve assembly 200 according to this embodiment when a flapper lid 230 is in a first position. FIG. 7B is a diagram showing a state of the configuration example of the float valve assembly 200 according to this embodiment when the flapper lid 230 is in a second position. FIG. 7C is a side view of the float valve assembly 200 in the state shown in FIG. 7B. To describe the inside of float valve assembly 200, a part of the outer wall is shown as a sectional view in FIG. 7A and FIG. 7B.

Figure 8A:
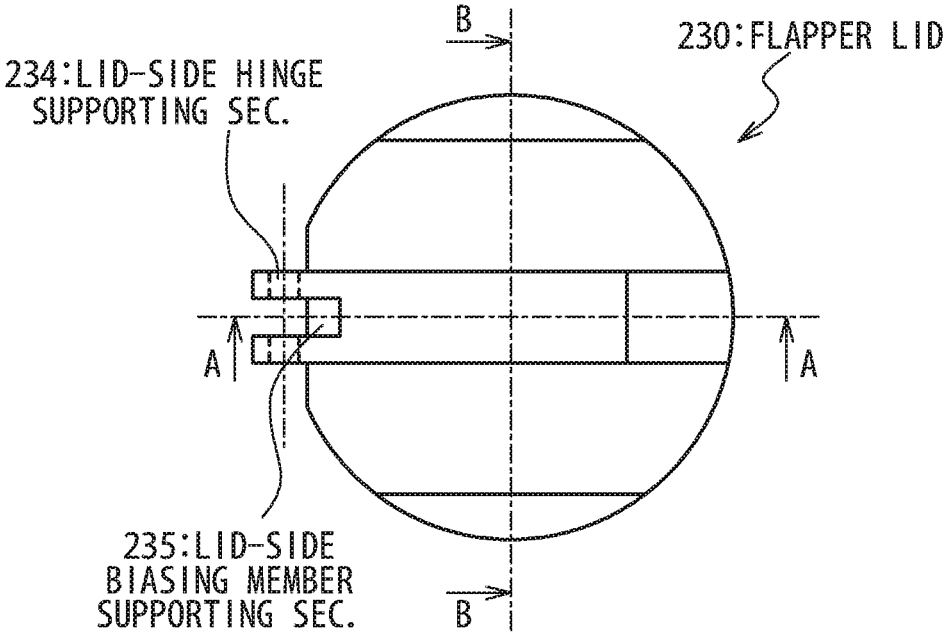
FIG. 8A is a diagram showing the flapper lid of the float valve assembly shown in FIG. 7A and FIG. 7B.
Figure 8B:
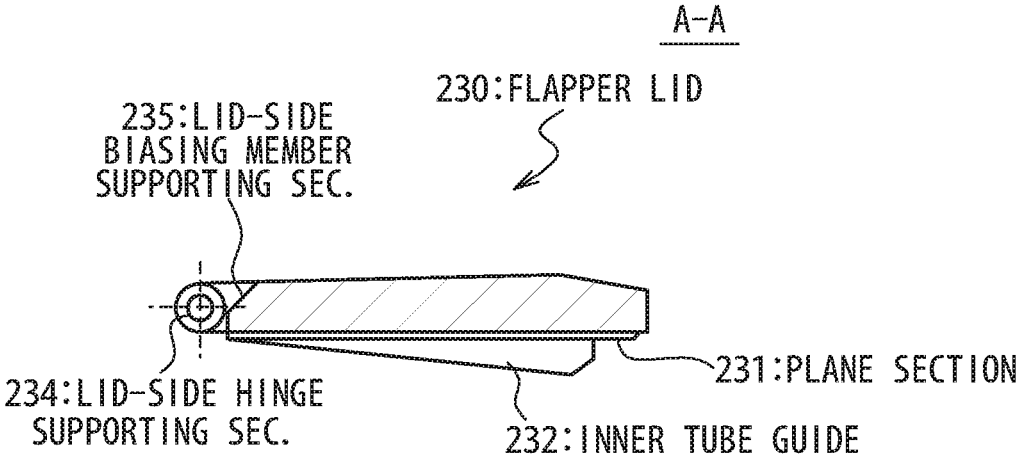
FIG. 8B is a sectional view of the flapper lid shown in FIG. 8A along the sectional line A-A.
Figure 8C:
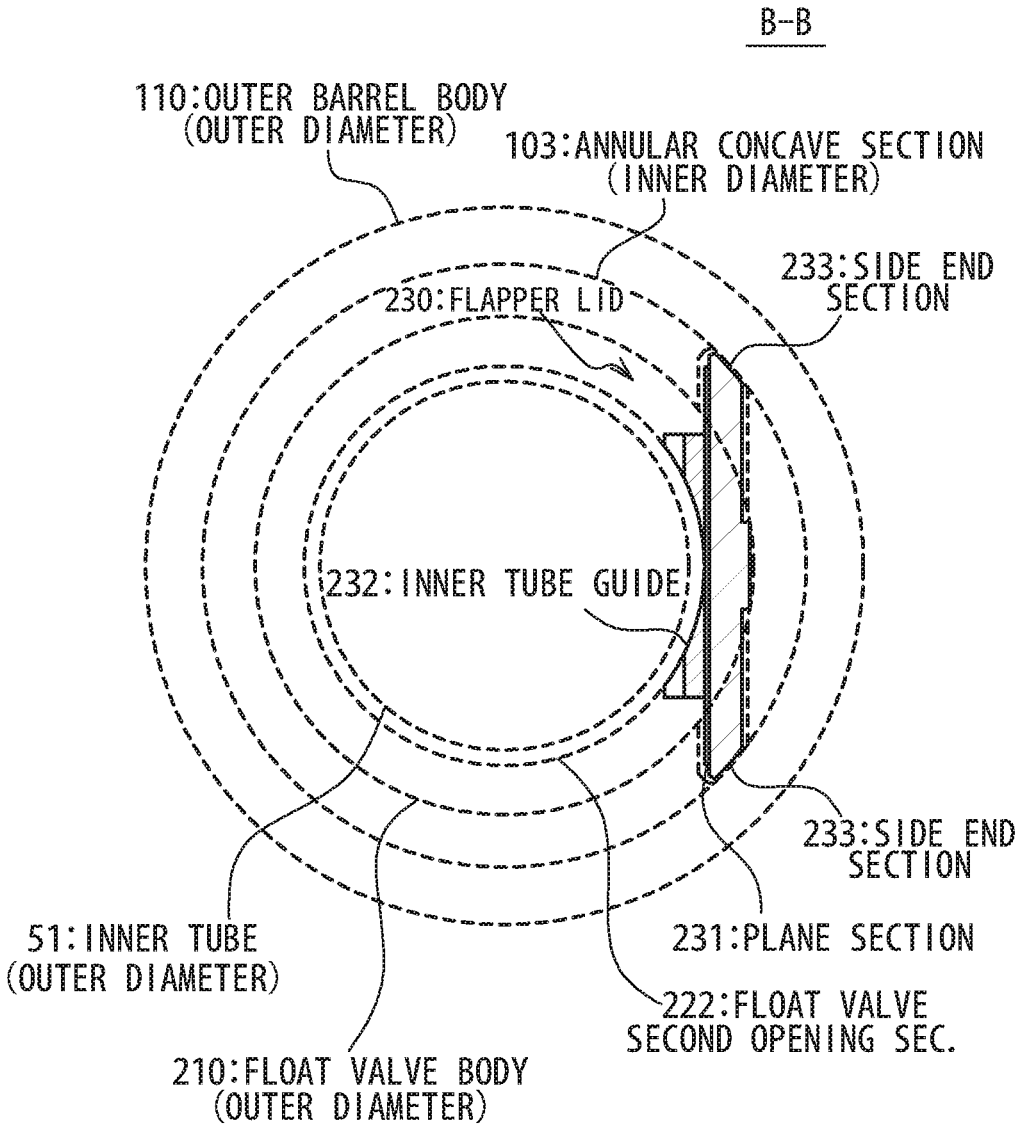
FIG. 8C is a sectional view of the flapper lid shown in FIG. 8A along the sectional line B-B.

FIG. 8A is a diagram showing the flapper lid 230 of the float valve assembly 200 shown in FIG. 7A to FIG. 7C. FIG. 8B is a sectional view of the flapper lid 230 shown in FIG. 8A along the line A-A. FIG. 8C is a sectional view of the flapper lid 230 shown in FIG. 8A along the line B-B.

The float valve assembly 200 shown in FIG. 7A to FIG. 7C has a float valve body 210, the flapper lid 230, a hinge 240, a biasing member 250, a closing sealing member 224, a retainer 225 and fixing sealing members 211 and 212.

The float valve body 210 shown in FIG. 7A to FIG. 7C has an upper-side float valve first end section 201, a lower-side float valve second end section 202 and a float valve middle section 203. Here, the float valve middle section 203 is arranged between the float valve first end section 201 and float valve second end section 202.

Note that the float valve body 210 may be formed by assembling the float valve first end section 201, the float valve second end section 202 and the float valve middle section 203 which are separately formed.

The float valve first end section 201 has a body-side hinge supporting section 213, a body-side biasing member supporting section 214 and a float valve first opening section 221. The float valve second end section 202 has a float valve second opening section 222. The float valve middle section 203 has a side opening 223.

The flapper lid 230 shown in FIG. 7A to FIG. 7C and FIG. 8A to FIG. 8C has a plane section 231, an inner tube guide 232, a side end section 233, a lid-side hinge supporting section 234 and a lid-side biasing member supporting section 235.

A connection relation of components shown in FIG. 7A to FIG. 7C and FIG. 8A to FIG. 8C will be described.

The float valve first end section 201 has a cylindrical shape. The retainer 225 also has a cylindrical shape and is engaged with the inside of float valve first end section 201. The closing sealing member 224 is formed of an elastic material and has an annular shape, and is arranged between the float valve first end section 201 and the retainer 225. However, an annular end surface of the closing sealing member 224 is exposed to the space inside the float valve body 210. An aggregate of the float valve first end section 201, the retainer 225 and the closing sealing member 224 has a cylindrical shape, and a space inside the aggregate is called the float valve first opening section 221. At this time, the exposed part of the closing sealing member 224 is arranged to surround the opening surface on the lower side of the float valve first opening section 221. Note that float valve first opening section 221 has a shape and a size in which the inner tube 51 can pass through the opening section. Here, it is assumed that the inner diameter of the float valve first opening section 221 is DF2. Note that in this embodiment, DF2 is strictly equal to the inner diameter of the retainer 225.

The fixing sealing members 211 and 212 each have an annular shape, and are arranged to surround the outer circumference of the float valve first end section 201. Here, the float valve first end section 201 may have ditches on the outer circumference to position the fixing sealing members 211 and 212.

Note that the fixing sealing members 211 and 212 are feasible with the configuration different from the above. For example, the ditch is provided for the surface of the float valve first end section 201 which comes in contact with the upper side sub 300, and the closing sealing member 224 may be arranged in this ditch.

The float valve second end section 202 has a cylindrical shape and the space thereinside is called the float valve second opening section 222. The float valve second opening section 222 has a size and shape such that the inner tube 51 can pass through the inside space. Here, in this embodiment, the inner diameter of the float valve second opening section 222 is assumed to be DF2 which is the same as that of the float valve first opening section 221. Note that the inner diameter of the float valve first opening section 221 is not necessary to be the same as that of the float valve second opening section 222, if the inner tube 51 can pass.

The float valve middle section 203 has a cylindrical shape, and is connected at its upper-side end section with the float valve first end section 201 and at its lower-side end section with the float valve second end section 202. The space inside the float valve middle section 203 is communicated at its upper-side with the float valve first opening section 221 and at the lower-side with the float valve second opening section 222.

A side opening 223 is provided on the side surface of the float valve middle section 203. The side opening 223 is wide so that the flapper lid 230 can pass through it when the flapper lid 230 moves between the first position and the second position.

The float valve first end section 201 and the flapper lid 230 are connected through the hinge 240. The hinge 240 has a column shape, and pierces a body-side hinge supporting section 213, and a lid-side hinge supporting section 234 in the longitudinal direction of the hinge itself. Here, it is desirable that the hinge 240 is fixed on the body-side hinge supporting section 213 or the lid-side hinge supporting section 234 with screws.

The flapper lid 230 can turn around a rotation axis which is set in the longitudinal direction of the hinge 240 to move between the first position and the second position. Here, when the flapper lid 230 is in the the first position, the flapper lid 230 tightly fits with the closing sealing member 224 to close the float valve first opening section 221 (a passage). Also, when the flapper lid 230 is in the second position, the flapper lid 230 opens the passage of the float valve first opening section 221. At this time, the flapper lid 230 does not interfere with inner tube 51 which passes through the float valve assembly, and the second position is an evacuation position. The second position is a position where the whole flapper lid 230 does not overlap with the float valve first opening section 221 (or the float valve second opening section 222), viewing the outer barrel assembly 100 in the longitudinal direction.

The biasing member 250 biases the flapper lid 230 for the first position. In this embodiment, the biasing member 250 is a coil-like torsion spring, and the coil portion is arranged around the hinge 240. The one end of the biasing member is in contact with a body-side biasing member supporting section 214, and the other end thereof is in contact with a lid-side biasing member supporting section 235. Here, the body-side biasing member supporting section 214 in this embodiment is deflected in a direction of a load toward the float valve body 210 from the biasing member 250 such that one end of the biasing member 250 does not come off. In the same way, the lid-side biasing member supporting section 235 in this embodiment is deflected in a direction of a load toward the flapper lid 230 from the biasing member 250, to a part of flapper lid 230 such that the other end of the biasing member 250 does not come off.

An assembling operation of the float valve sub 2 in this embodiment will be described below.

When the float valve assembly 200 is attached on the inside of the outer barrel assembly 100, the float valve first end section 201 is received by the outer barrel first receiving section 112 and is fixed. Also, the float valve second end section 202 is received by the outer barrel second receiving section 122 and is supported. At this time, the float valve second opening section 222 is communicated with the outer barrel second opening section 102.

When the float valve assembly 200 is attached on the inside of the outer barrel assembly 100, the fixing sealing members 211 and 212 seal the float valve first end section 201 and the outer barrel first receiving section 112 in liquid-tightness. Here, when the outer diameter of the float valve assembly 200 is DF1, DF1 is approximately equal to the minimum inner diameter DO1 of the outer barrel first section 110. Here, it is desirable that DF1 is equal to or less than DO1.

When the upper side sub 300 is attached to the outer barrel assembly 100 to which the float valve assembly 200 has been attached, the float valve first opening section 221 is communicated with the lower-side opening section of the upper side sub 300. At this time, the float valve assembly 200 is fixed at its upper side by being connected with the upper side sub 300. In this state, the inner tube 51 can pass through the upper side sub 300, the float valve first opening section 221, the float valve second opening section 222 and the outer barrel second opening section 102.

An operation when the flapper lid 230 of the float valve sub 2 in this embodiment closes the float valve first opening section 221 will be described.

If the inner tube 51 exits from the inside of float valve body 210 when the inner barrel section 50 is lifted up by the drilling rig 12, the flapper lid 230 moves to the first position shows in FIG. 7A by an operation of the biasing member 250.

The flapper lid 230 has a flat plane section 231 in the peripheral area of its main surface at least. The plane section 231 comes into contact with the closing sealing member 224 when the flapper lid 230 moves to the first position. Thus, the flapper lid 230 closes the passage communicated with the float valve first opening section 221. As a result, an upper portion and a lower portion with respect to the float valve sub 2 in the inner space of the drill string 1 are isolated by the flapper lid 230. In this state, even if fluid flows into the inside of drill string 1 from the lower portion of the float valve sub 2, the fluid does not leak out to the upper portion of the float valve sub 2 so that the blowout can be prevented.

The inventors confirmed that the float valve sub 2 having the inner diameter of 98.5 mm had durability upto the pressure of about 20 megapascals, as the result that an experiment was carried out in which water pressure was applied from the float valve second opening section in the first position of the flapper lid of the float valve sub 2 in this embodiment. Note that this experiment result is merely an example and does not limit the scope of the present invention.

An operation of the float valve sub 2 in this embodiment when the flapper lid 230 releases the float valve first opening section 221 will be described.

When the inner barrel section 50 is inserted to the end section of outer barrel section 30 so that the inner tube 51 enters the inside of float valve body 210, the flapper lid 230 moves to the second position shown in FIG. 7B if the force of the inner tube 51 pushing the flapper lid 230 exceeds the force of the biasing member 250.

When the flapper lid 230 moves to the second position, a part of the flapper lid 230 protrudes out of the float valve body 210 through the side opening 223. This protruding part is called a side end section 233 to make an explanation easy. As shown in FIG. 8C, the side end section 233 has a size and shape to be accommodated inside the annular concave section 103 of the outer barrel assembly 100.

As shown in FIG. 8C, the inner tube guide 232 of the flapper lid 230 has a curved surface similar to the outer circumference surface of the float valve second opening section 222 (the inner circumference surface of the float valve second end section 202). Since the inner circumference surface of the float valve second end section 202 has a curved surface complementary to the side surface of the inner tube 51 as a column-like member, the curved surface of the inner tube guide 232, too, has a shape complementary to the side surface of the inner tube 51. By this curved surface, the inner tube guide 232 makes it possible for the inner tube 51 to be inserted and extracted more stably when the flapper lid 230 is in the second position.

The inner diameter of the annular concave section 103 in this embodiment will be described.

Figure 9:
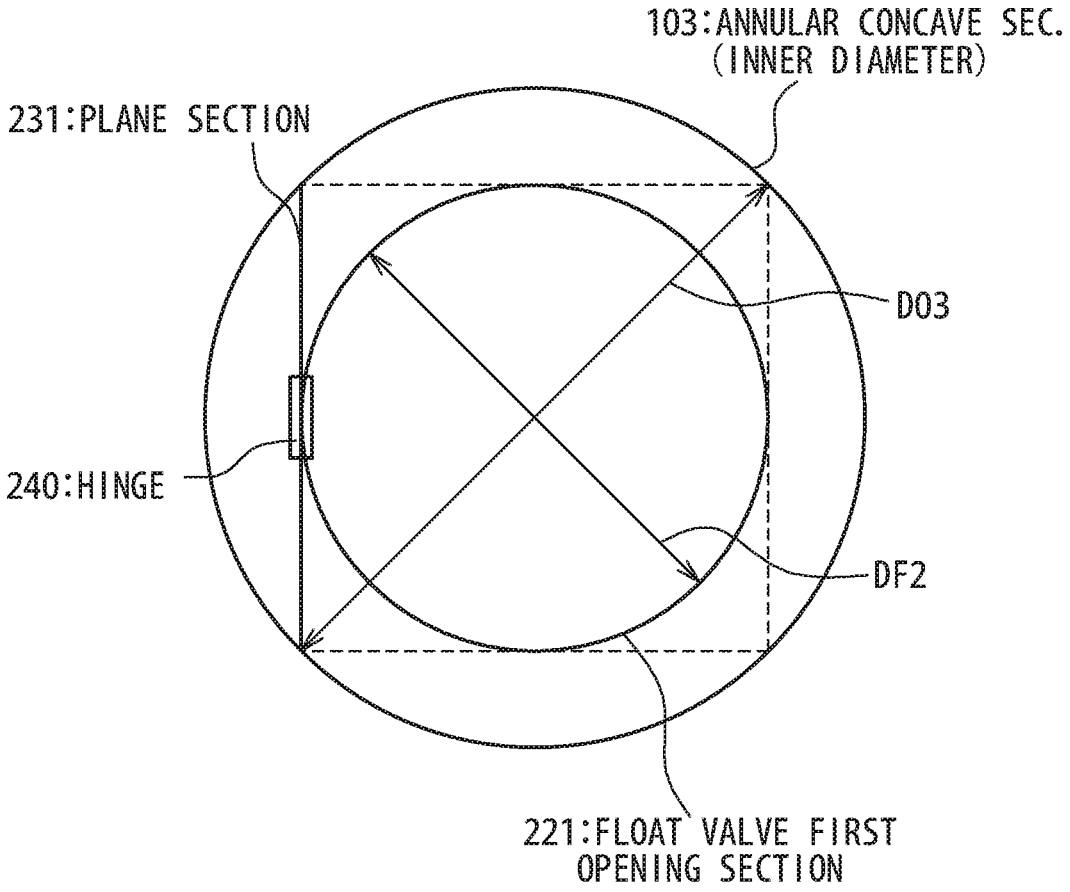
FIG. 9 is a diagram showing a geometrical relation between the inner diameter of an annular concave section according to the embodiment and the outer diameter of a float valve first opening section.

FIG. 9 is a diagram showing geometrical relation of the inner diameter DO3 of the annular concave section 103 and the diameter DF2 of the float valve first opening section 221 in this embodiment. At first, when paying attention to the plane section 231 of the flapper lid 230, the size of the plane section 231 must be equal to or more than the diameter DF2 of the float valve first opening section 221 at least. Next, to store the flapper lid 230 moved to the second position in the annular concave section 103 so as not to interfere with the inner tube 51, it is necessary that the inner diameter DO3 of the annular concave section 103 is longer than a diagonal line of the square circumscribing a circle of the diameter DF2. That is, the length DO3 must be equal to or more than a value obtained by multiplying the length DF2 by the square root of 2. In other words, the square of length DO3 must be equal to or more than twice the square of length DF2. Strictly, since the thickness of hinge 240, the thickness of flapper lid 230 and so on must be taken into account, the above-mentioned relation between the length DO3 and the length DF2 can be shown by the following equations:

$$DO3>DF2\times\sqrt{2}$$

Or $$DO3\times DO3>2\times DF2\times DF2$$

The minimum value of the length DO3 is determined as mentioned above. Note that the maximum value of the length DO3 depends on the strength required to the float valve sub 2 as mentioned above. That is, assuming that the minimum value of thickness of the side wall of the outer barrel assembly 100 which satisfies the required strength is Tmin1, and the outer diameter of outer barrel assembly 100 is DO4, the maximum value of the length DO3 is equal to the difference between DO4 and twice of Tmin1. Therefore, the numerical limitation of the length DO3 can be shown by the following equation:

$$DO4-2\times T\min 1\geq DO3>DF2\times\sqrt{2}$$

Second Embodiment

In the first embodiment, the explanation has been carried out, presupposing the so-called riserless drilling system, to simplify the structure. Here, the explanation will be made, presupposing the so-called riser drilling system in a second embodiment.

In the riser drilling system, by filling the drilling hole 17 with muddy water to satisfy the condition of "stratum pressure<muddy water pressure<stratum destruction pressure", it is prevented that the inner wall surrounding the drilling hole 17 collapses.

Note that the condition of "stratum pressure<muddy water pressure<stratum destruction pressure" is met in an open hole without any casing. However, because the stratum pressure rises as the drilling proceeds, the muddy water pressure must be raised according to this. When the drilling is continued without casing, the muddy water pressure exceeds stratum destruction pressure in an upper portion of the open hole, so that muddy water destroys the stratum and the stratum collapses. In the riser drilling system, the collapse is prevented by carrying out the casing before such a situation. As a result, in the riser drilling system, a depth possible to drill is improved drastically, as compared with the so-called riserless drilling system in which such a technique is not used.

The muddy water used in the riser drilling system needs a suitable adjustment physically and chemically. The muddy water adjusted in this way is generated by drawing up muds produced by the drilling of the stratum 16 and seawater in the periphery to the drilling rig 12 by the riser pipe, and adjusting the characteristics by a muddy water adjustment device loaded in the drilling rig 12. The adjusted muddy water is sent to the bottom of drilling hole 17 through the inside of drill string 11.

Figure 10:
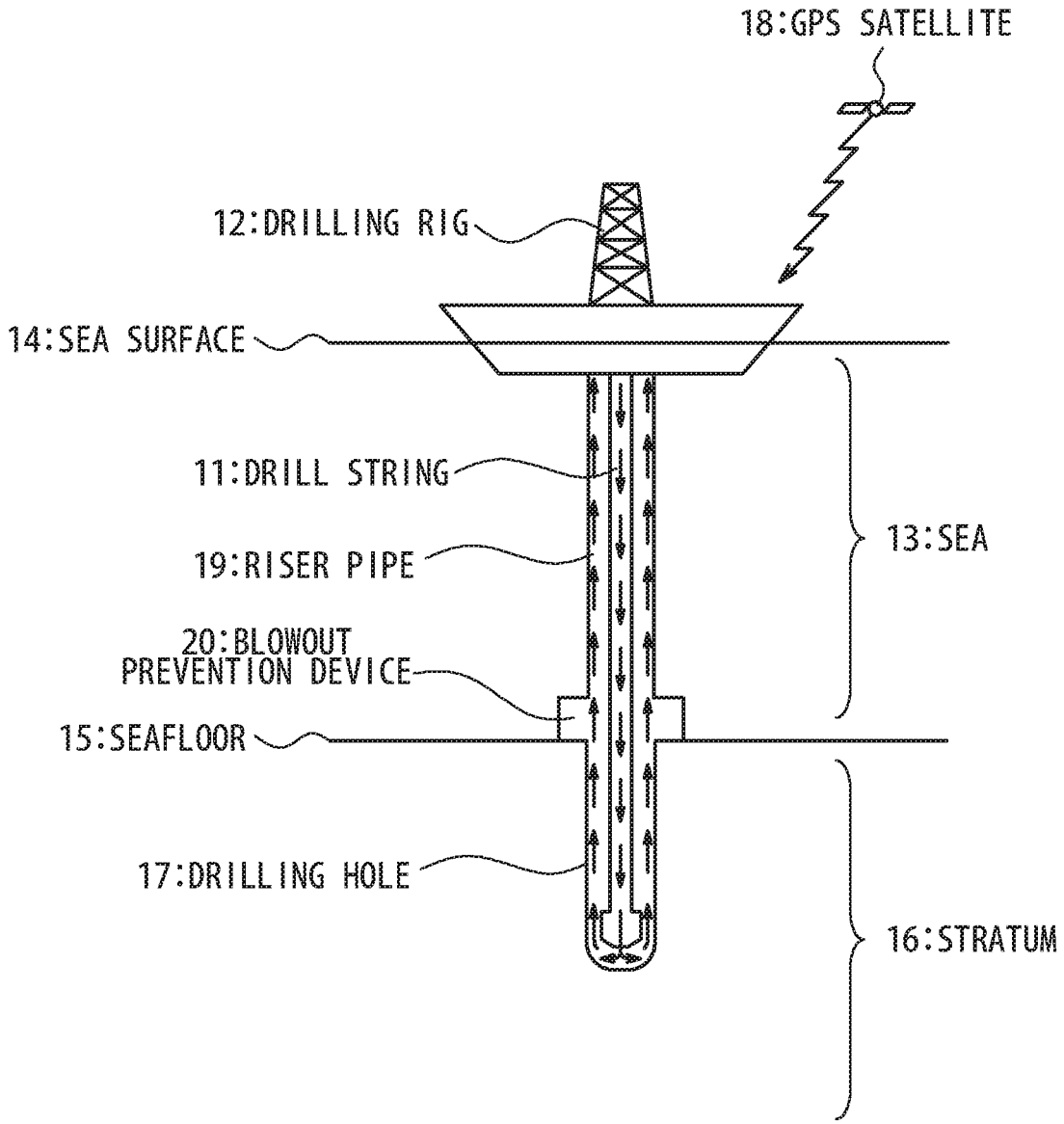
FIG. 10 is a diagram showing a configuration example of the coring system using a riser drilling system.

FIG. 10 is a diagram showing a configuration example of the coring system using the riser drilling system. FIG. 10 shows a system equivalent to a coring system using the riserless drilling system shown in FIG. 1 which is added with a riser pipe 19 and a blowout prevention device 20. Note that illustration of the muddy water adjustment device loaded in the drilling rig 12 is omitted.

In the configuration example shown in FIG. 10, the riser pipe 19 is provided around the drill string 11 and extends from the seafloor 15 to the drilling rig 12. Note that the blowout prevention device 20 which connects the drilling hole 17 and the riser pipe 19 is provided on the seafloor 15.

The muddy water passes through the inside of drill string 11 in which the inner barrel section 50 is not inserted, when the muddy water moves from the drilling rig 12 to the bottom of drilling hole 17. At this time, the muddy water passes through the float valve sub 2, too. Because the flapper lid 230 can move to the direction in which the float valve first opening section 221 is released, if pressed by the muddy water entering from the upper-side, the flapper lid 230 does not hinder the passage of muddy water.

In this way, the float valve sub 2 according to the present invention is possible to apply to the riser drilling system easily.

As described above, the embodiments of the invention have been described specifically. However, the present invention is not limited to the embodiments, and various changes and modifications are possible in a range which does not deviate from the gift of the the present invention. Also, the features described in the embodiments can be freely combined in a range of no technical contradiction.

For example, the annular concave section 103 has been described above in case that its shape is a rotating body rotating around a rotation axis of the drill string 11. This description is based on consideration of a possibility that the annular concave section 103 is formed by lathe processing or the float valve assembly 200 rotates to the outer barrel assembly 100 when the upper side sub 300 is attached or removed. However, as mentioned above, the annular concave section 103 is not always necessary to have a rotation body shape if a function can be accomplished of receiving the flapper lid 230 protruding from a cylindrical shape of the float valve assembly 200. The annular concave section 103 may be a concave section having another shape such as an optional extension section, a grinding section, a cutting section, and so on.

EXPLANATION OF THE CODE

1 bottomhole assembly
2 float valve sub
10 core barrel
11 drill string
12 drilling rig
13 sea
14 sea surface
15 seafloor
16 stratum
17 drilling hole
18 GPS satellite
19 riser pipe
20 blowout prevention device
30 outer barrel section
31 core bit
32 near bit sub
33 drill collar sub
34 landing sub
35 head sub
36 landing ring
37 latching section
40 core
50 inner barrel section
51 inner tube
52 core liner
53 length control mechanism
54 swivel mechanism
55 landing mechanism
56 latching mechanism
57 fishing neck
58 lock bolt
71 first casing pipe
72 second casing pipe
73 third casing pipe
74 fourth casing pipe
100 outer barrel assembly
101 outer barrel first opening section
102 outer barrel second opening section
103 annular concave section
110 outer barrel first section
111 outer barrel first connection section
112 outer barrel first receiving section
120 outer barrel second section
121 outer barrel second connection section
122 outer barrel second receiving section
130 outer barrel middle section
200 float valve assembly
201 float valve first end section
202 float valve second end section
203 float valve middle section
210 float valve body
211 fixing sealing member
212 fixing sealing member
213 body-side hinge supporting section
214 body-side biasing member supporting section
221 float valve first opening section
222 float valve second opening section
223 side opening
224 closing sealing member
225 retainer
230 flapper lid
231 plane section
232 inner tube guide
233 side end section
234 lid-side hinge supporting section
235 lid-side biasing member supporting section
240 hinge
250 biasing member
300 upper side sub
500 lower side sub

The invention claimed is:

1. A float valve sub comprising:
an outer tube assembly; and
a float valve assembly arranged detachably in an inside of the outer tube assembly,
wherein the float valve assembly comprises:
a first end section having a cylindrical shape;
a second end section having a cylindrical shape;
a valve assembly middle section arranged between the first end section and the second end section; and
a lid section attached to the first end section,
wherein the lid section moves turnably between a first position for closing a passage of the first end section and a second position for opening the passage of the first end section,
wherein the valve assembly middle section has a side opening through which a part of the lid section is possible to pass,
wherein the outer tube assembly comprises:
a first section having an inner circumference surface complementary to an outer circumference surface of the first end section to receive the first end section;
a second section having an inner circumference surface complementary to an outer circumference surface of the second end section to receive the second end section; and
an outer tube assembly middle section arranged between the first section and the second section,
wherein the outer tube assembly middle section has a concave section possible to receive the lid section in the second position,
wherein a minimum inner diameter of the first section is larger than a minimum inner diameter of the second section,
wherein an inner diameter of the concave section is larger than the minimum inner diameter of the first section, and
wherein the inner diameter of the concave section of the outer tube assembly middle section is larger than a value obtained by multiplying the inner diameter of the second end section of the float valve assembly by the square root of 2.

2. The float valve sub according to claim 1, wherein the lid section has an upper surface possible to close the passage of the first end section, and
wherein the upper surface has a curved surface complementary to a side surface of a column-like member which can pass through the passage of the first end section.

3. The float valve sub according to claim 2, further comprising:
an annular retainer arranged on the inner circumference surface of the first end section; and
an annular seal member arranged between the retainer and the first end section,
wherein the seal member seals the lid section in the first position in liquid tightness.

4. The float valve sub according claim 1, further comprising:

an annular retainer arranged on the inner circumference surface of the first end section; and an annular seal member arranged between the retainer and the first end section, wherein the seal member seals the lid section in the first position in liquid tightness.

* * * * *